US005105944A

United States Patent [19]

Ingalls et al.

[11] Patent Number: 5,105,944

[45] Date of Patent: Apr. 21, 1992

[54] SHIPPING PACKAGE FOR PERFLUORINATED MEMBRANE

[75] Inventors: Arthur N. Ingalls; Marian H. Sharpless, both of Fayetteville, N.C.

[73] Assignee: E. I. du Pont de Nemours and Company, Wilmington, Del.

[21] Appl. No.: 582,656

[22] Filed: Sep. 17, 1990

[51] Int. Cl.[5] ..... B65D 85/67; B65H 75/28

[52] U.S. Cl. ..... 206/412; 206/397; 242/74

[58] Field of Search ..... 206/389, 397, 407, 408, 206/410, 412, 497; 242/74, 68.5

[56] References Cited

U.S. PATENT DOCUMENTS

| | | | |
|---|---|---|---|
| 341,633 | 5/1886 | Barker | 242/74 |
| 1,949,259 | 2/1934 | Salsman | 206/389 |
| 1,983,278 | 12/1934 | Flanigan | 206/407 |
| 2,069,300 | 2/1937 | Carlson | 242/74 |
| 2,401,842 | 6/1946 | Slater | 206/407 X |
| 2,878,628 | 3/1959 | Curry | 206/497 X |
| 2,906,399 | 9/1959 | Lysle | 206/410 |

*Primary Examiner*—Bryon P. Gehman

[57] ABSTRACT

Membranes such as fluorine-containing cation exchange membranes are wrapped on a roll for shipment, without using adhesive to fasten the membrane to the core or to itself at the end of the wrap. Instead, paper is taped to the core and interleaved with the membrane. At the end of the wrap, paper is again interleaved with the membrane and the paper is taped to itself.

11 Claims, 3 Drawing Sheets

SHIPPING PACKAGE FOR PERFLUORINATED MEMBRANE

FIELD OF THE INVENTION

This invention relates to a package for a membrane such as fluorinated cation exchange membrane, wherein the membrane is rolled on a cylindrical core without contacting any adhesive.

BACKGROUND

Membranes such as fluorinated or fluorine. containing membranes used widely for the manufacture of chlorine and sodium hydroxide, have limited tear resistance even when cloth reinforced. They must reach their destination free of wrinkles or other damage, the risk, of which increases as the membrane size increases (some membranes are larger than 1.5×4.5 meters (m)).

Some membranes are shipped flat in wooden boxes. This is awkward, since the box must be kept level to avoid damaging the membranes. Certainly this method would be extremely awkward for 1.5×4.5 m membranes.

Membranes have been shipped on cores, particularly cylindrical cores. They have been secured to the core with a masking tape such as ST-48 masking tape commercially available from Englewood. ST-48 masking tape has a strong adhesive. The final wrap of membrane around the core has been taped to itself with the same tape. It has proved difficult to remove this masking tape from the membrane without tearing the membrane, especially if the package has been accidentally dropped or otherwise mishandled. If no tape is used or masking tape with a weaker adhesive such as Englewood ST-24 masking tape is used, the package is unstable, the membrane tending to slide or "telescope" on itself along the length of the package, so the package is no longer cylindrical. This can lead to damage during shipping.

At times, enclosing film has been wrapped around the membrane roll and taped to itself and to the core. If this overwrap is applied too loosely, the membrane telescopes with resultant damage, while, if it is applied to the core with too much pressure against the membrane roll, the edges of the membrane tend to be damaged in compression.

SUMMARY OF THE INVENTION

Damage from tearing when the membrane is removed from the package has been prevented by securing to the core a sheet of material such as paper of substantially the same width as that of the membrane, then interleaving the first membrane with the paper. Additional membrane sheets are interleaved or overlapped with the previous membrane sheet. A sheet of material such as paper is interleaved with the last sheet of membrane, and the outside of the roll is secured by securing the paper to itself.

Optionally, the package may be further stabilized against telescoping by at least one of three methods:

a) the wrapped package is overwrapped with flexible plastic film which is enough longer than the membrane roll that the film can be taped to the core, and/or b) the wrapped package is shrink wrapped with heat shrinkable film, and/or c) the core is provided with end sections which are spaced apart from each other by a least the width of the membrane, the end sections having a diameter which is larger than that of the paper/membrane/paper portion of the package. Preferably, the end sections have an outer diameter about the same have an outer diameter about the same as the inner diameter of the outer shipping tube which is described below.

If both (b) and (c) are used, the shrink wrapping includes the end sections on the core.

An outer shipping tube may be used to protect the assembly of core, paper/membrane/paper, and, optionally, the overwrap film or shrink tubing and end sections. Any suitable means may be used for this purpose.

BRIEF DESCRIPTION OF DRAWINGS

Further details of the invention are explained below with the help of the examples illustrated in the drawings as follows.

DETAILS OF THE INVENTION

Figure 1:
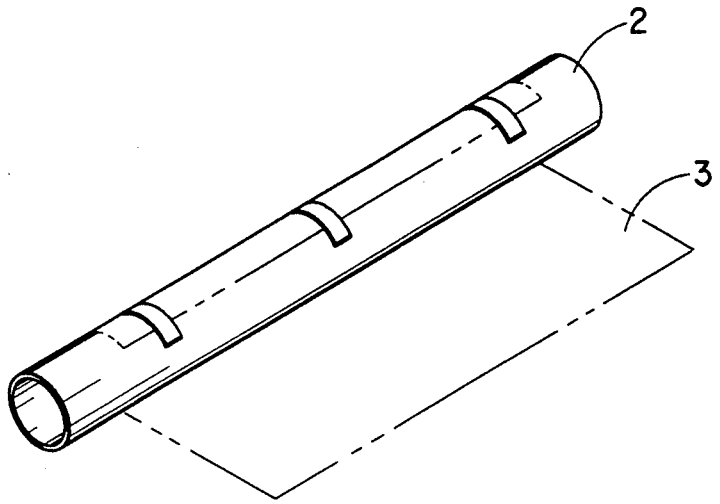
FIG. 1 is an overall view of the core on which the paper and membrane sheets are wrapped, showing the first sheet of paper being taped to the core.

FIG. 1 shows the core on which the paper and membrane sheets are wrapped. The core (2) on which the paper and membrane sheets are wrapped may be made of any suitable material. It should be strong and stiff enough to support the weight of the wrappings, but any of several materials may be used. If the membrane has been partially dried in the last step of its preparation prior to wrapping, a cardboard tube may be used. Typically, the cardboard might be about 9 centimeters (cm) in diameter and have a wall thickness of 7 millimeters (mm). If the membrane is not dried prior to packaging, a cardboard tube would probably be unsuitable because it would become less stiff when wet with water. In this case a plastic tube or pipe could be used. One suitable plastic is linear polyethylene.

Figure 2:
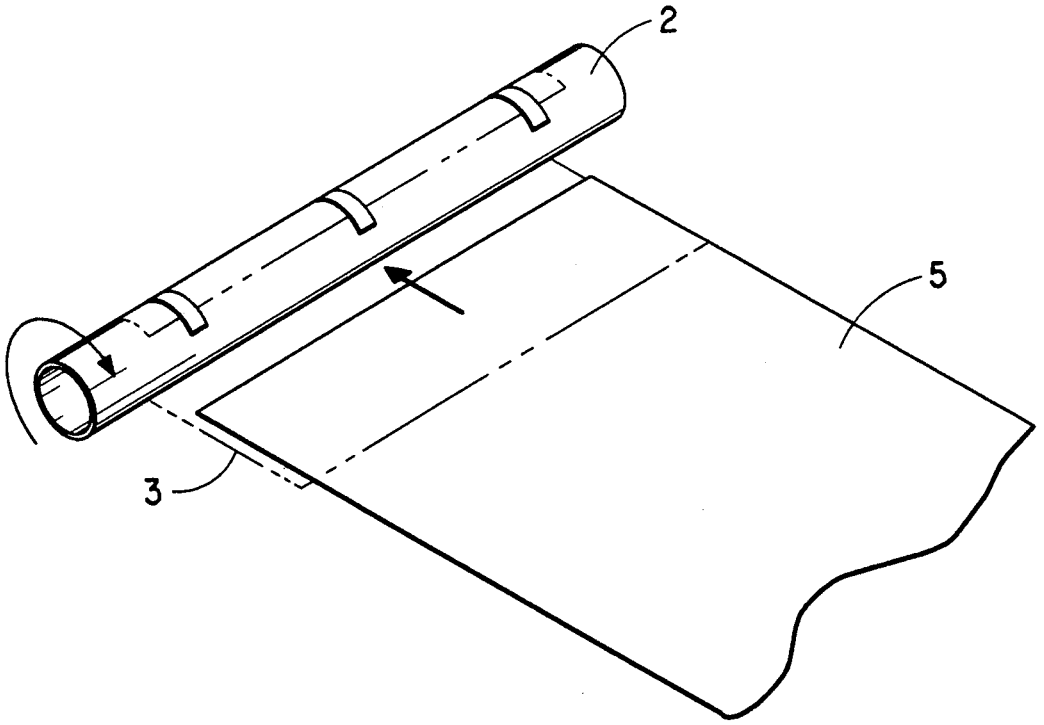
FIG. 2 is an overall view of the initial sheet of membrane interleaved with the paper.

A particularly important feature of the present invention is that the membrane is not taped to the core (2). Instead, as shown in FIG. 1, a first edge of a sheet of material such as paper (3), preferably of substantially the same width as the membrane, is secured or adhered, preferably with tape, to a core (2) and wrapped at least once around the core (2) so that, as shown in FIG. 2, a second edge overlaps the first edge of the sheet at least once before interleaving a first edge of the membrane (5) with the second edge of the sheet of material (3). The second edge in each case is parallel and opposite to the first edge. The width of the paper (3) is not critical, but it is preferably about 6 mm narrower than the membrane (5), so a slight misalignment does not result in having paper stick out the ends of the membrane roll. If the paper is substantially narrower than the membrane, only one or two wraps of the paper should be made before interleaving with the membrane is started in order to minimize deformation of the membrane during shipping.

The type of paper is not critical. It can be what is known commercially as 40 pound (18 kilogram (kg)) brown kraft or 50 pound (23 kg) bleached kraft paper. For the purpose of this document, the term paper is used, even though an equivalent material may be used. A suitable paper substitute would be one that does not slide on the core or exchange a significant amount of a chemical, even water, with the membrane.

The length of the paper is not critical. It should be at least long enough to make one wrap around the core after taping and to allow the second edge of the paper to overlap the first edge by at least 5 cm, but there is no upper limit to the length.

The type of tape used to tape the paper to the core is not critical. It should be of normal tape thickness, because a very thick tape would deform the membrane wrapped on the paper. Such a problem could be minimized by using several wraps of paper before interleaving with membrane, thus partly obscuring the deformation of the outer paper layer due to the tape. One suitable kind of tape is masking tape, which is relatively easy to remove when the package is disassembled. Other means of securing or adhering, such as by gluing, are included within the scope of this invention.

The distance of interleaving, which is the distance the paper and membrane or membrane and subsequent membrane overlap on the roll, should be at least 5 cm and preferably 12–25 cm, but is not critical. This statement applies at the inside of the roll where paper is on the inside, followed by membrane, and on the outside of the roll, where membrane is followed by paper. Where one sheet of membrane follows another, the distance of interleaving should be at least 5 cm but is otherwise not critical.

Figure 3:
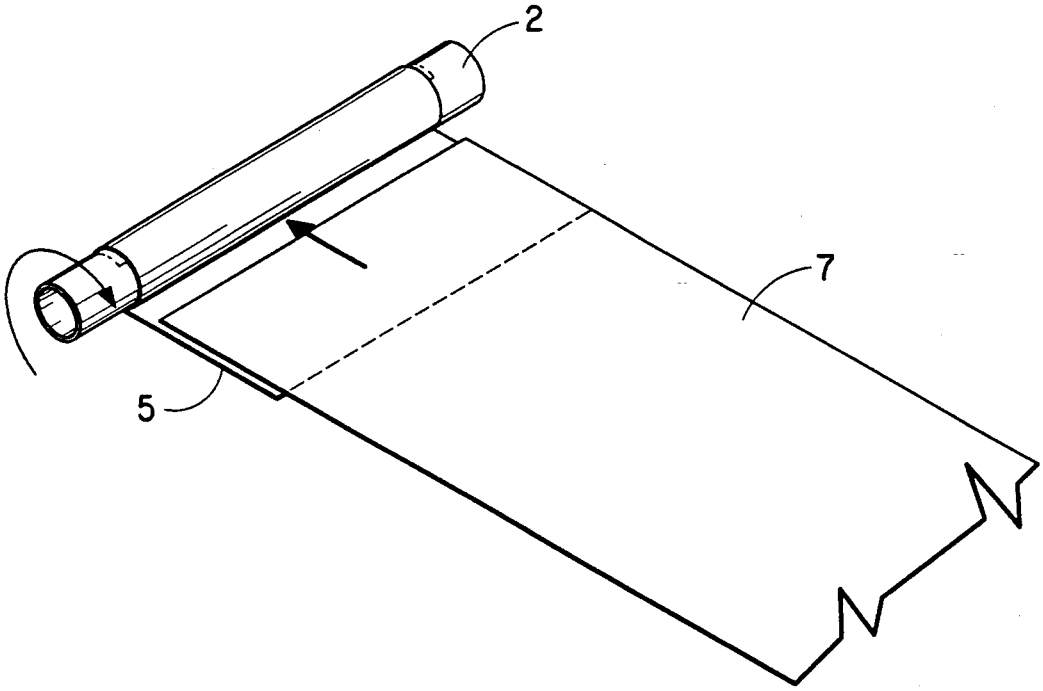
FIG. 3 is an overall view showing subsequent sheets of membrane interleaved with the first sheet of membrane.
Figure 4:
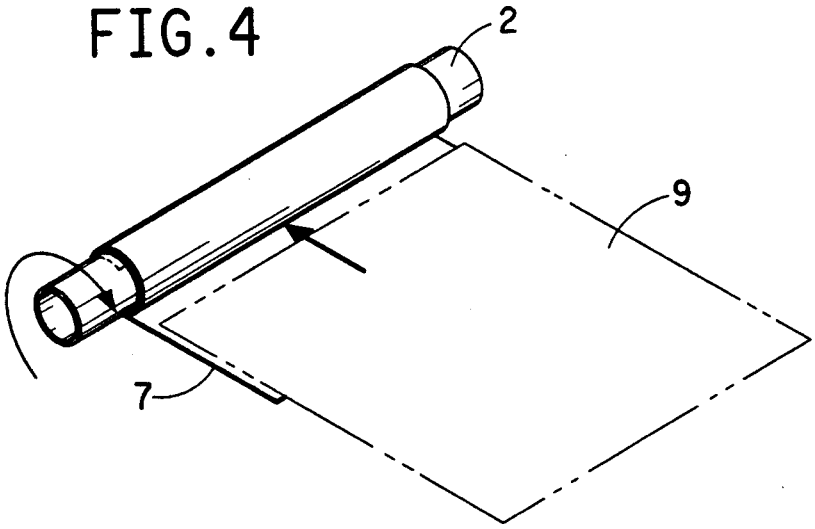
FIG. 4 is an overall view of the final sheet of membrane interleaved with the final sheet of paper.
Figure 5:
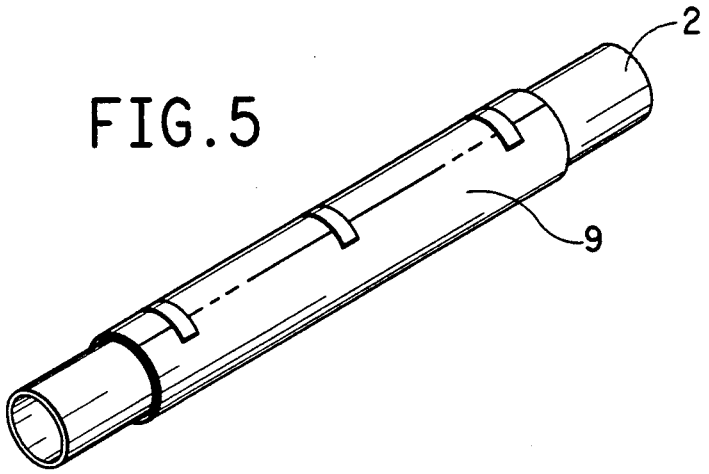
FIG. 5 is an overall view showing the final sheet of paper taped to itself.

By interleaving, as shown in FIG. 2 and FIG. 3, it is meant that a first edge of a first membrane (5) is inserted under the second edge of a first paper (3) having its first edge secured to a core (2) and then is wrapped onto the core (2). As shown in FIG. 3, a first edge of a second membrane (7) is then inserted under the second edge of the first membrane (5) and also wrapped around the core (2). Additional membranes are added in like manner. Finally, as shown in FIG. 4, after the last membrane (7) to be included in the package is in place, a first edge of a second paper (9) is inserted under the second edge of the last membrane (7) and the paper is wrapped around the bundle until it overlaps itself at least once and can be secured to itself as by taping, as more fully shown in FIG. 5.

The number of sheets of membrane which may be placed in one package is not critical, except that the core plus wrappings should be able to fit into an outer shipping tube as discussed below. If there are end sections on the core, as described below, it is desirable that the paper/membrane/paper wrappings should have a diameter that does not exceed that of the end sections. If narrow membrane is being shipped, the package may contain more than one roll of paper/membrane/membrane on one core.

The tension used in wrapping is related to the interleaving overlap employed. With larger interleaving overlap, lower tension should be needed to hold the membrane in place. Suitably, the membranes can be wrapped onto the core hand tight.

The outer wrap of paper applied after the last membrane is in place should be long enough to permit it to overlap itself at least once, but otherwise the length is not critical. Several wraps of the paper can be made. The roll is stabilized by securing the paper to itself as with tape at a few locations or across the whole width of the roll. The type of tape used is open to the same options described above for the initial taping of the paper to the core. There is no critical upper limit for the thickness of the tape used at the outside of the roll.

If non-heat-shrinkable film is used outside the paper/membrane/paper roll, its nature is not critical, except it should be flexible and chemically inert to the membrane. A suitable film is 100 micrometer linear polyethylene film. This film extends beyond the end of the paper/membrane/paper roll and is taped to itself to minimize telescoping of the roll. A glass-reinforced adhesive tape may be used.

Figure 6:
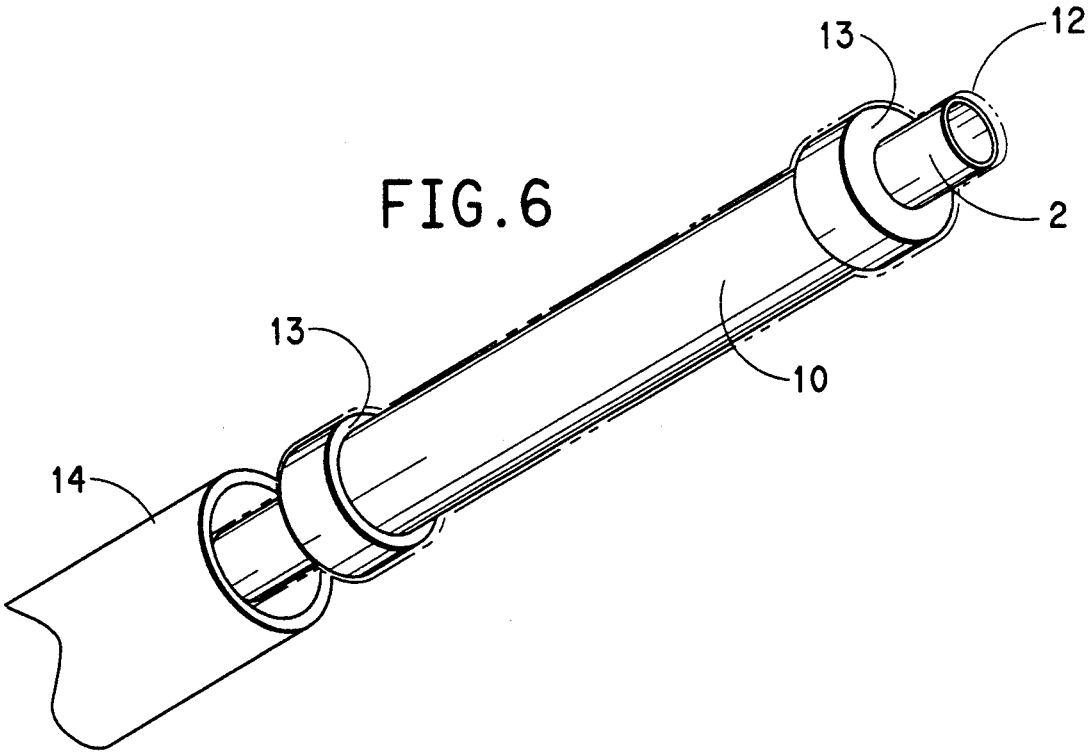
FIG. 6 shows the entire packing container including the core, membranes, end sections, paper overwrap and plastic overwrap.

As shown in FIG. 6, the paper/membrane/paper roll may be encased in heat-shrinkable tubing (12), which is shrunk into place by methods known in the art. This reduces the likelihood of trouble due to telescoping of the roll. Any heat-shrinkable plastic may be used. Olefin polymers and copolymers are typical.

Optionally, the paper/membrane/paper roll (10) may be supported on the ends by end sections or rings (13) which are fixedly located on the core (2), the distance between the end sections being greater than the width of the membrane in the package. The diameter of the end sections is not critical, but is suitably about the same as the inner diameter of the shipping tube. The end sections may be made of almost any material, including plastic, plastic foam, cardboard (for dry membrane), and wood. High density polyethylene rings are preferred.

The end sections (13) may be fixed in place on the core (2) by any suitable method. Possibilities include interference fit, tape, clamps, wedges, screws, and pins.

If more than one roll of narrow membrane is wrapped on a single core, an end section may be installed on the core between the rolls as well as at the ends of the core.

If both end sections and shrink tubing are used, the shrink tubing should cover the end sections as well as the paper/membrane/paper roll.

The package as described above, consisting of core (2), paper/membrane/paper roll (10), optional end sections (13), and optional shrink tubing (12), is placed in an outer shipping tube (14) for protection during storage and shipping. The material of construction of the shipping tube (14) is not critical. Suitably it may be made of plastic tubing or pipe. For example, it could be 8 mm polystyrene pipe. Means should be provided for centering the package described above in the shipping tube.

Suitable means for centering include wrapping the paper/membrane/paper roll with sufficient foamed polystyrene sheet (microfoam), suitably 6 mm thick, so that the roll fits snugly in the shipping tube. Other means include using end sections with an outer diameter about the same as the inner diameter of the shipping tube, or using an end cap in the shipping tube which contains an interior portion which is designed to support and center the core.

Each end section (13) preferably has an outer diameter about equal to the inner diameter of the shipping tube (14) and an aperture about the diameter of the core (2) through its center so as to help center the roll in the shipping tube (14). The preferred end sections or rings (13) fit tightly on the core (2) and fill the space between the core. They do not have to be removed from the core in order to remove the membrane. They protect the membrane from damage when removed from the shipping tube and placed on a flat surface that might be rough. Packaging time and cost is less. Contamination from filler material such as microfoam is eliminated and the final package has a more attractive appearance than when the microfoam is used.

The ends of the shipping tube (14) should be closed to keep out dirt and prevent longitudinal motion of the package in the tube. The ends of the shipping tube (14) may be threaded on the inside, into which a pair of removable threaded end caps may be fitted; or the ends of the shipping tube may be threaded on the outside, over which a pair of removable threaded external end caps may be fitted. The end caps may be equipped with centering means to help center the paper/membrane/-paper roll in its shipping container.

One or more handles may be affixed to the shipping tube for easy handling.

EXAMPLES

EXAMPLE 1

A first 1.50 meter edge of a 1.50 by 0.61 meter sheet of 40 pound brown kraft paper was secured with Englewood ST-48 masking tape to a 9.0 cm diameter by 1.83 meter long cardboard core and the paper was wrapped 2 times around the core. A first 1.53 meter edge of a 1.53 by 3.48 meter membrane was inserted about 10 cm under the 1.50 meter long free edge of the paper and the membrane was wrapped around the core. A second membrane was inserted about 10 cm under the free edge of the first membrane and wrapped around the core. Three more membranes were added for a total of five using the same interleaving as above. Finally, a 1.50 meter first edge of a 1.50 by 0.61 meter sheet of 40 pound brown kraft paper was inserted about 10 cm under the free edge of the last membrane, was wrapped 2 times around the roll and secured to itself with Englewood ST-48 masking tape. End rings having an inside diameter about equal to the outside diameter of the core and an outside diameter of 15.1 cm were slipped over each end of the core and the resulting assembly was slipped into an outer shipping tube constructed of polystyrene and having an inside diameter of about the same as the outside diameter of the end rings. End caps were taped to the shipping tube. The package was then submitted to two interstate shipments and then opened for inspection. No telescoping or membrane damage occurred. The package was resealed and submitted to an additional interstate shipment. The shipping tube was removed, shrink wrap was applied over the brown kraft paper and end rings, and the roll was returned to the shipping tube as above. The package was subjected to another interstate shipment. This time an end cap on the shipping tube broke and the membrane telescoped slightly tearing the brown paper where the tape had been applied. The membrane, however, was undamaged.

We claim:

1. A package for membrane comprising a core and a means for securing at least one sheet of membrane on the core such that the membrane is free from contact with any kind of adhesive, wherein a first sheet of membrane is secured to said core by adhering a first edge of a sheet of paper of substantially the same width as said membrane to the core and wrapped on said core, and a first edge of said first sheet of membrane is interleaved with a second edge of the paper for an effective overlap distance at a tension sufficient to hold the membrane in place, a first edge of additional subsequent sheets of membrane through and including the final sheet of membrane are each interleaved with a second edge of the preceding membrane at a tension sufficient to hold each sheet of membrane in place, the second edge in each case being parallel to and opposite the first edge.

2. The package of claim 1 wherein the overlap distance is at least 5 cm.

3. The package of claim 1 wherein the paper is 40–50 pound kraft paper.

4. The package of claim 1 wherein a first edge of a second sheet of paper is interleaved with the second edge of the final sheet of membrane, the said second sheet of paper then being wrapped around the said final sheet of membrane at least one time and secured to itself with adhesive.

5. The package of claim 4 wherein the core is equipped with end sections having an outside diameter larger than the resulting diameter of the core, paper and membrane.

6. The package of claim 5 wherein shrink film is secured so as to be over the paper wrap and the end sections.

7. The package of claim 4 further comprising an outer shipping tube.

8. The package of claim 1 further comprising end sections fixedly attached to said core wherein the outer diameter of the end sections is substantially the same as the inner diameter of the shipping tube.

9. The package of claim 4 wherein shrink film is secured outside the outer paper wrap.

10. The package of claim 1 wherein the membrane is substantially dry and the core is made of cardboard.

11. The package of claim 1 wherein the membrane is moist and the core is made of plastic.

* * * * *